US006163906A

United States Patent [19]

Kay

[11] Patent Number: 6,163,906

[45] Date of Patent: Dec. 26, 2000

[54] LOAD SUPPORTING APPARATUS FOR A PERSON

[76] Inventor: Ronald D. Kay, 3549 Williams Rd., Ft. Worth, Tex. 76116

[21] Appl. No.: 09/413,441

[22] Filed: Oct. 6, 1999

Related U.S. Application Data

[63] Continuation of application No. 09/151,323, Sep. 11, 1998, abandoned.

[51] Int. Cl.[7] ..... A61G 7/08

[52] U.S. Cl. ..... 5/662; 5/658; 5/81.1

[58] Field of Search ..... 5/24.1, 658, 662, 5/85.1, 87.1, 81.1; 410/8, 50, 51, 10, 12, 104, 105; 248/508.1, 499, 500

[56] References Cited

U.S. PATENT DOCUMENTS

| | | | |
|---|---|---|---|
| 798,114 | 8/1905 | Rosenthal . | |
| 1,341,483 | 5/1920 | Slocum . | |
| 1,515,473 | 11/1924 | Frechin . | |
| 1,840,170 | 1/1932 | Neils . | |
| 2,052,914 | 9/1936 | Williams | 105/368 |
| 2,891,490 | 6/1959 | Elsner . | |
| 3,713,616 | 1/1973 | Bowers . | |
| 4,688,843 | 8/1987 | Hall | 410/8 |
| 4,850,769 | 7/1989 | Matthews . | |
| 5,177,822 | 1/1993 | Kassai . | |
| 5,181,289 | 1/1993 | Kassai . | |

*Primary Examiner*—Terry Lee Melius
*Assistant Examiner*—Fredrick Conley
*Attorney, Agent, or Firm*—Arthur F Zobal

[57] ABSTRACT

An elongated guide member is supported by a support system over a bed. The guide member has an elongated cavity with a slot formed in its lower wall leading to the cavity. The slot has a plurality of spaced apart enlarged openings along its length. A plunger is provided which has a first portion located in the cavity and a second portion extending through the slot for movement along the length of the cavity and slot. Biasing means is provided for normally urging the first portion of the plunger toward the upper side of the cavity to normally maintain the first portion of the plunger in the cavity. A gripping device is coupled to the lower portion of the plunger to allow a person to move the plunger laterally in the cavity in line with a selected one of the enlarger openings such that a downward force applied to gripping device by a person in bed below the guide member will move the first portion of the plunger into the selected enlarged opening which prevents further lateral movement of the plunger and allows the person to raise, lower, or reposition himself or herself.

10 Claims, 5 Drawing Sheets

FIG. 4
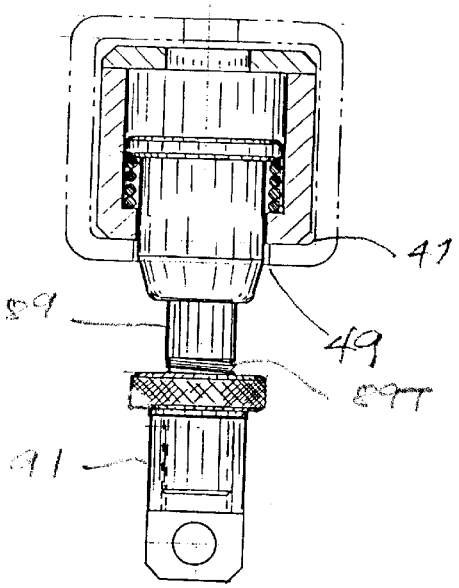
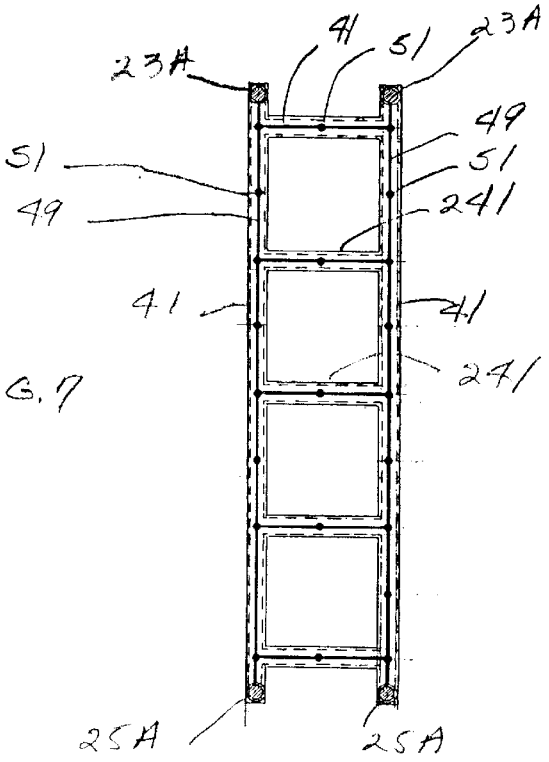
FIG. 7
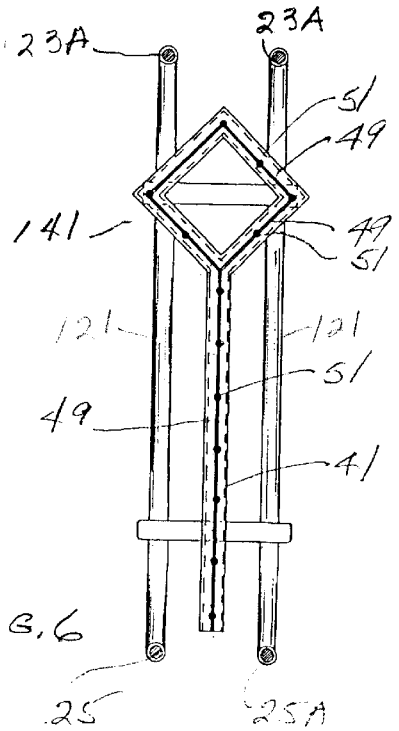
FIG. 6

131
123A
223
133
21A
223L
41
125A
225
133
21B
21
225L

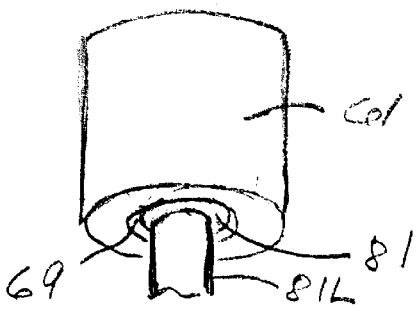
FIG. 11
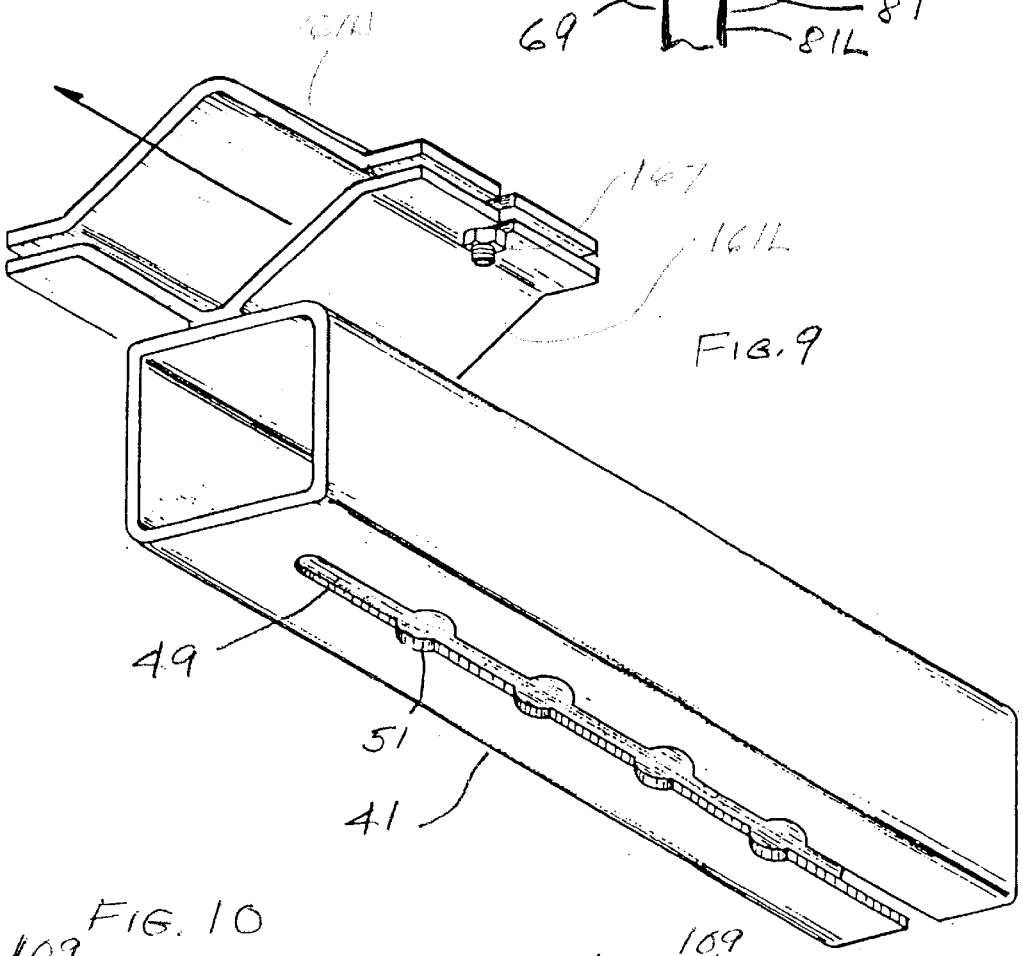
FIG. 9
FIG. 10
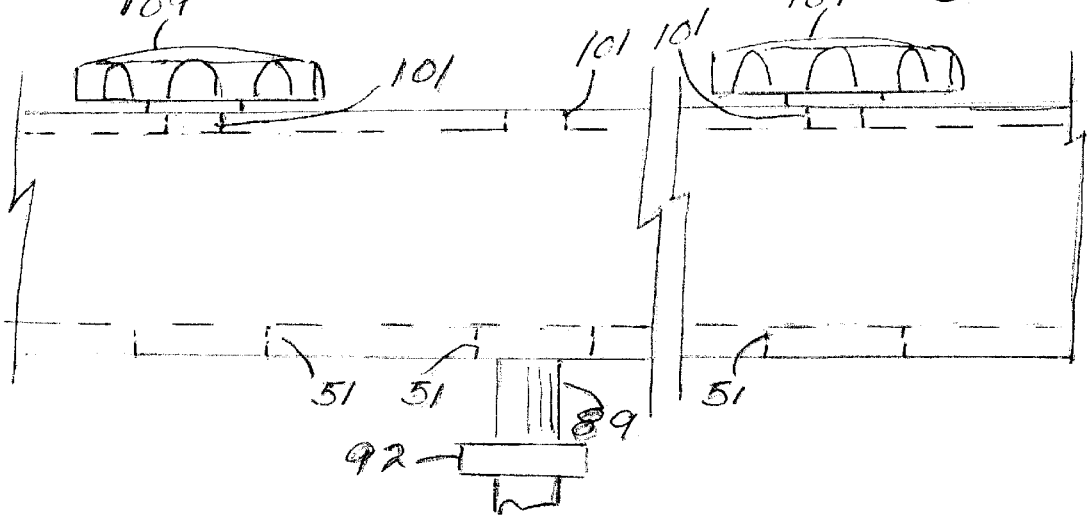

LOAD SUPPORTING APPARATUS FOR A PERSON

This application is a continuation of U.S. application Ser. No. 09/151,323, filed Sep. 11, 1998 now abandoned.

BACKGROUND OF THE INVENTION

1. Field of the Invention

The invention relates to an apparatus for use with a bed to allow a patient to move himself or herself.

2. Description of the Prior Art

The standard apparatus in use today to allow a patient in bed to move himself or herself are limited in their ability to allow the patient to move to different positions on or about the bed.

SUMMARY OF THE INVENTION

It is an object of the invention to provide a new and useful load supporting apparatus which can be readily adjusted to allow a patient to move himself or herself to different positions on or about a bed.

The invention comprises an elongated guide member having an elongated cavity with a slot formed in its lower wall leading to the cavity. The slot has a plurality of spaced apart enlarged openings along its length. A plunger is provided which has a first portion located in the cavity and a second portion extending through the slot for movement along the length of the cavity and slot. Biasing means is provided for normally urging the first portion of the plunger toward the upper side of the cavity to normally maintain the first portion of the plunger completely in the cavity. A gripping means is coupled to the lower portion of the plunger to allow a person to move the plunger in the cavity in line with a selected one of the enlarged openings such that a downward force will pull the first portion of the plunger into the selected enlarged opening which prevents further lateral movement of the plunger and allows the person to raise or lower himself or herself.

In a further aspect, support means is coupled to the guide member to support the guide member over or near the bed.

In another aspect, a threaded aperture is formed through the upper wall of the cavity in line with at least one of the enlarged openings for receiving a threaded member to be screwed into the cavity for engaging the top of the plunger to prevent lateral movement of the plunger in the cavity.

BRIEF DESCRIPTION OF THE DRAWINGS

FIG. 4 is a view similar to that of FIGS. 3 with the plunger in a lower locked position.

FIG. 6 is a bottom view of another embodiment of the guide of the invention.

FIG. 7 is a bottom view of still another embodiment of the guide of the invention.

FIG. 9 is an isometric view of the guide of FIG. 7 with an upper clamp.

FIG. 10 illustrates two locking devices used for limiting lateral movement of a plunger along a guide.

FIG. 11 is an isometric view of the plunger of the apparatus.

DESCRIPTION OF THE PREFERRED EMBODIMENTS

Figure 5:
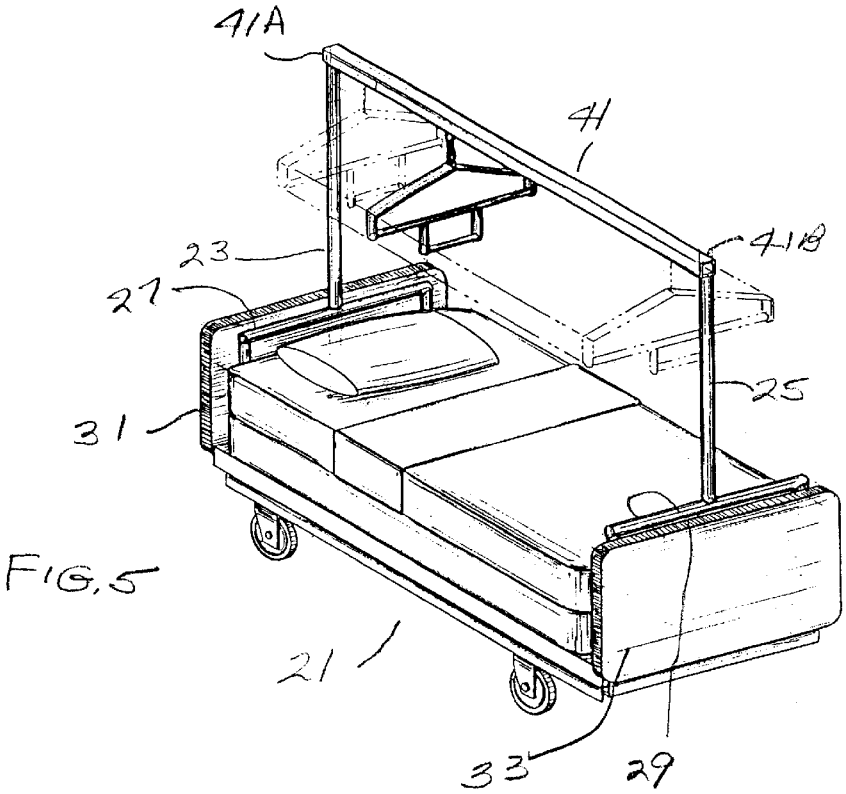
FIG. 5 illustrates one embodiment of a support system for supporting the guide of FIGS. 1–4.
Figure 1:
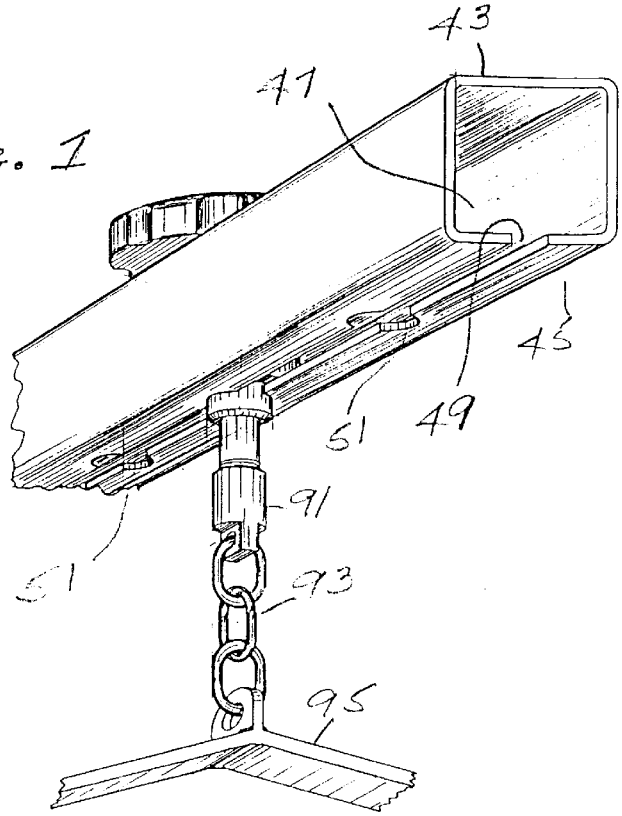
FIG. 1 is a partial perspective view of a guide and plunger of the invention.

Referring now to FIGS. 1–5, there is disclosed a bed 21 for a patient. The bed 21 has two metal support members 23 and 25 connected to metal end members 27 and 29 which turn are connected to the end frame members 31 and 33 of the bed. The support members 23 and 25 extended vertically upward and are connected to and support opposite ends 41A and 41B of a metal guide 41 of the invention. The guide 41 is C-shaped in cross-section at least along a substantial portion of its length. The guide 41 comprises wall structure having an upper side 43 and a lower side 45 with an elongated cavity 47 extending between its ends 41A and 41B. The lower side 45 has an elongated slot 49 formed therein leading to the cavity 47. The slot 49 has a plurality of spaced apart enlarged openings or stop holes 51 along its length.

Figure 2:
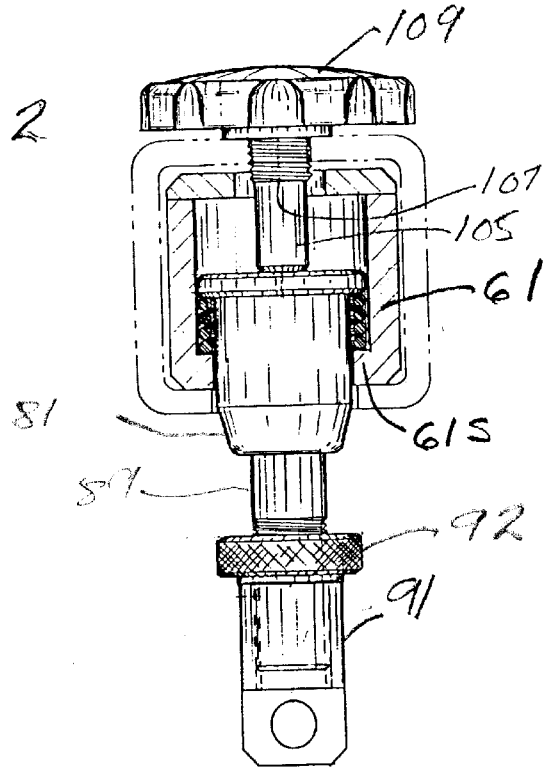
FIG. 2 is a cross-sectional view of the guide of FIG. 1.
Figure 3:
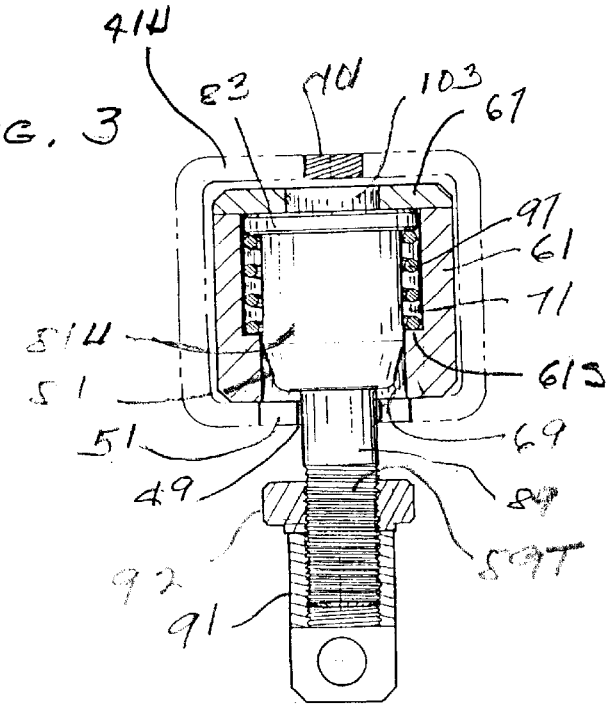
FIG. 3 is a cross-sectional view of the guide of the invention with the plunger in a normally raised position.

Referring to FIGS. 2–4, located in the cavity 47 is a hollow cylindrical plastic member 61 having a cavity 71 with a lower opening 69 and an upper wall 67 with an upper opening 103. Located in the cavity 71 of member 61 is an enlarged cylindrical portion 81U of a plunger 81. A lower cylindrical member 89 connected to portion 81U extends freely through the opening 69 and hence freely through the slot 49. The member 89 is threaded at 89T and is screwed into a threaded hole of a chain attachment 91. A locknut 92 is screwed onto the threads 89T of the member 89 which locks the two members 89 and 91 together. Member 91 is connected to one end of a chain 93 having its other end connected to a handle 95. The upper end of plunger portion 81U has an enlarged circular member 83 connected thereto. The member 61 has a shoulder 61S for supporting the lower end of an annular metal spring 97 which surrounds the plunger portion 81U with its upper end engaging the lower edge of the member 83. Thus the spring 97 normally urges the plunger 81 in an upper position in the cavity 47 such that member 61 and the plunger 81 can be moved laterally to different positions in the cavity 47 by pulling lightly and laterally on the handle 95. The plunger portion 81U has an outside diameter greater than the width of the slot 49 but less than the diameter of the opening 69 of the member 61 and less than the diameters of the stop holes 51 of the guide 41. When the plunger portion 81U is located in a stop hole 51, the plunger cannot move laterally along the length of the guide 41. Thus when the plunger 81 is aligned with one of the enlarged stop holes 51, the plunger portion 81U can be pulled downward against the spring 97 through the opening 69 of member 61 and into the selected stop hole 51 as shown in FIG. 2, to prevent lateral movement of the member 61 and the plunger 81 along the guide 41. The member 61 remains in the cavity 47 of the guide. The plunger 81 can be pulled downward by pulling downward on the handle 95.

In using the apparatus for raising and or repositioning purposes, the patient may reach up and grab the handle 95 and move the handle 95 and hence the plunger 81 in line with a selected stop hole 51, pull down on the handle 95 to move the enlarged portion 81 U of the plunger in the selected stop hole 51 and then pull himself or herself to a setting position or to reposition himself or herself. An assistant also can move the plunger 81 over the desired stop hole 51 if necessary. In order to lower himself or herself, the patient, by way of the handle 95, may move the plunger 81 in line with the desired stop hole 51 pull down on the handle 95 and then lower himself or herself onto the bed.

Formed through the upper wall 41U of the guide 41 and through the wall 67 of member 61 in line with each stop hole 51 is a threaded aperture 101 and an aperture 103 respectively. A shaft 105 with threads 107 and a turning knob 109 connected to the shaft is provided to hold the plunger 81 in the selected stop hole 51 if desired. The threads 107 mate with the threads 101 such that the lower end of the shaft 105 can be inserted through the apertures 101 and 103 and the knob 109 turned to screw the shaft threads 105 in to the guide threads 101 to engage the lower end of the shaft 105 with the top 83 of the plunger and move the plunger downward into a selected stop hole 51 where it will remain until the shaft 105 is unscrewed from the guide threads 101.

If desired two of the members 105, 109 may be used to limit lateral movement of the plunger 81 along the guide 41. For example, the shafts 105 of two of the members 105, 109 may be screwed into the guide 41 in line with two selected stop holes 51 as shown in FIG. 10 to limit lateral movement of the plunger along the guide between the far left and right stop holes 51 of FIG. 10.

Referring to FIG. 6, the guide 41 may have the shape shown including a square guide portion 141 at and end of the guide 41 formed of guides similar to guide 41 but shorter. In FIG. 6, the cavity 47 of guide member 141 is in communication with the cavity 47 of guide 41 such that the plunger 81 may be moved into the cavity of guide 41 or into the cavity of guide 141 for insertion into a selected stop hole 51. In FIG. 7, the guide includes two parallel guides 41 with cross guide members 241 each of which is similar to guide 41 but shorter. In FIG. 7, the cavities of guide members 241 are in communication with the cavities of guides 41 such that the plunger 81 may be moved into the cavities of either of the guides 41 or into the cavities of either of the guides 241 for insertion into a selected stop hole 51. In each of FIGS. 6 and 7, the plunger 81 will be employed to allow the user to select a given stop hole to allow the user to raise, lower or reposition himself or herself as described in connection with FIGS. 1–5. In each of the embodiments of FIGS. 6 and 7, the threaded apertures 101 and apertures 103 may be employed to allow the threaded shaft 105 of member 105, 109 be screwed into the aperture 101 to engage the top 83 of the plunger 81 to allow the threaded shaft 105 of member 105, 109 to be employed to lock the plunger 81 in line with a selected stop hole 51. Two members 105, 109 may be employed to limit lateral movement of the plunger 81 in the cavities 47 as described above.

In FIG. 6, two support members 23A and two support members 25A may be connected to the end members 23 and 25. In FIG. 6, two support members 23A and two support members 25A may be connected to the end members 23 and 25. In FIG. 6 a rod 121 is connected to each pair of rods 23A and 25A to which the guides 41 and 141 are connected for support purposes. In FIG. 7, two support members 23A connected to guides 41 and two support members 25A connected to guides 41 may be connected to the end members 23 and 25 for support purposes. A pair of support members 23A and 25A support each guide 41.

Figure 8:
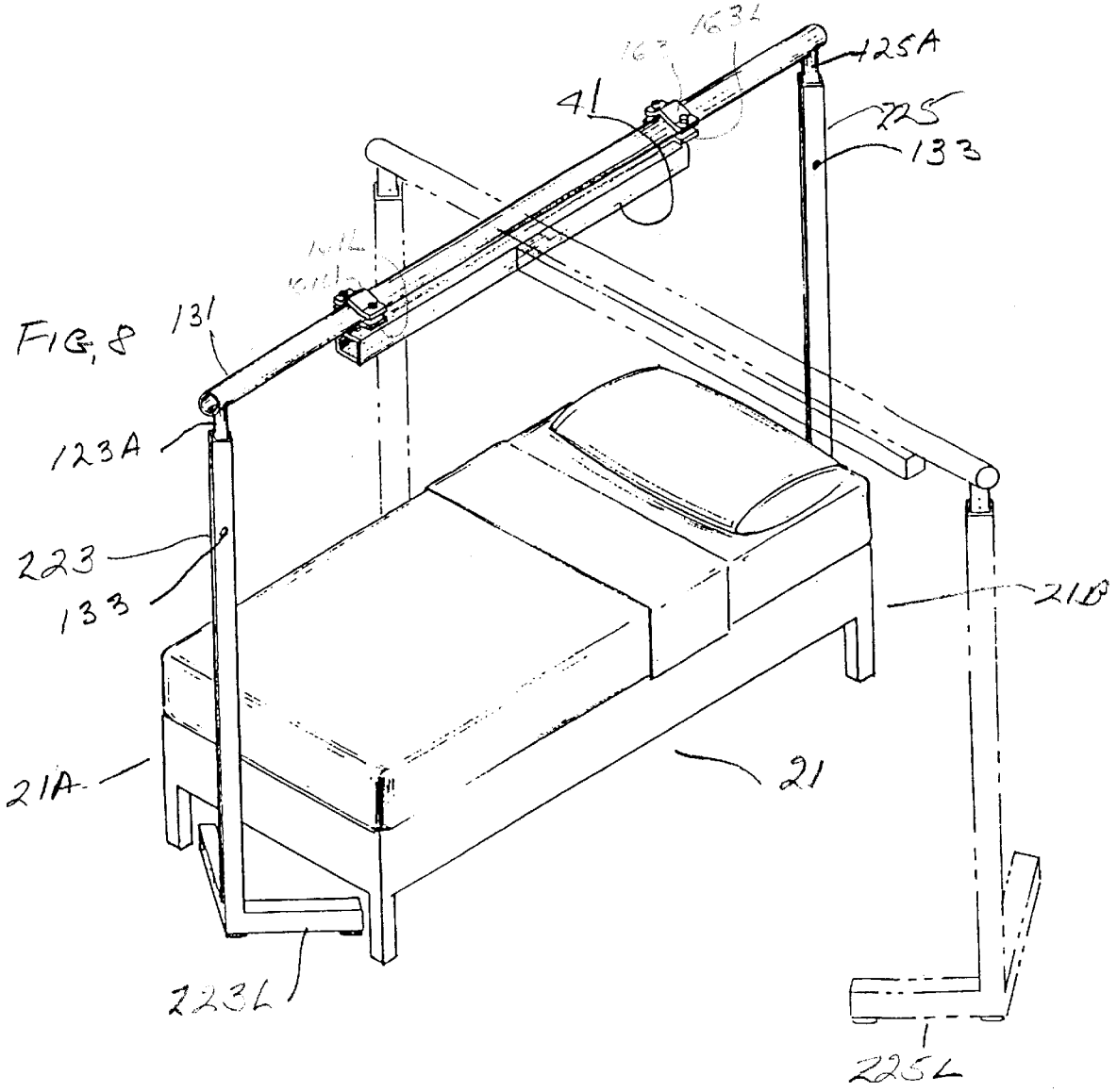
FIG. 8 is an isometric view of another support system for a guide of the invention.

Referring to FIGS. 8 and 9, there is shown a movable support system for supporting the guide. In this embodiment, the supports 223 and 225 have L-shaped legs 223L and 225L. The supports 223 and 225 are hollow and telescopically support rods 123A and 125A which have a rod 131 coupled to their upper ends. The rods 123A and 125A each have a plurality of vertically spaced apart holes (not shown) for receiving a pin 133 inserted through an aperture (not shown) formed through the walls of each of the supports 223 and 225. Thus the rod 131 can be adjusted vertically by moving the rods 123A and 125A up or down to desired heights where they are held in place by pins 133 inserted through the apertures formed through the walls of members 223 and 225 and into a selected vertical aperture formed in each of rods 123A and 125A. The guide 41 has two lower clamp members 161L and 163L connected to its upper side to be attached to two upper clamp members 161U and 163U by bolts 167 to clamp the guide to the lower side of the bar 131 as shown in FIG. 8. The support arrangement of FIGS. 8 and 9 can be located on opposite sides of the bed ends 21A and 21B as shown in solid form in FIG. 8 or transverse to the bed ends 21A and 21B as shown in dotted form in FIG. 8 for use for helping a person get on to or out of a bed or to reposition himself or herself on the bed.

Movable supports similar to those shown in FIGS. 8 and 9 may be used to support the guides of FIGS. 6 and 7.

What is claimed is:

1. A load supporting apparatus, comprising:

an elongated guide member having an upper side, a lower side, and two opposite end portions adapted to be supported with said lower side facing downward, said guide member having wall structure forming an elongated cavity between said two opposite ends with an elongated slot, having a given length, formed through said wall structure located on said lower side leading to said cavity, support means coupled to said guide member which supports said guide member with said lower side and said slot facing downward, said slot having a plurality of spaced apart enlarged openings, located along its length, a plunger having a first portion located in said cavity and a second portion extending through said slot, said plunger having a size and a shape sufficient for allowing said first portion and said second portion to move along the length of said cavity and slot respectively, biasing means normally urging said first portion of said plunger toward said upper side to normally maintain said first portion in said cavity, said first portion of said plunger comprising an end portion and an intermediate portion coupled between said end portion and said second portion, said end portion having a size greater than that of said enlarged openings which prevents said end portion from passing through said enlarged openings, gripping means coupled to said second portion of said plunger and extending downward for allowing a person below said guide member to move said plunger along said cavity and slot, said enlarged openings of said slot having sizes sufficient to allow said intermediate portion of said plunger to partially enter said enlarged openings when aligned therewith when a downward force is applied to said plunger by way of said gripping means to prevent movement of said plunger along said cavity with said end portion preventing said plunger from being removed from said slot by way of said enlarged openings, when said downward force is released, said biasing means moves said intermediate portion of said plunger out of any of said enlarged openings in which said intermediate portion of said plunger is located.

2. The apparatus of claim 1, comprising:

a threaded aperture formed through said upper side of said wall structure in line with at least one of said enlarged openings for receiving a threaded member adapted to be screwed into said threaded aperture and into said cavity for engaging said end portion of said plunger for holding said intermediate portion of said plunger in said one enlarged opening to prevent movement of said first portion of said plunger along said cavity.

3. The apparatus of claim 1, comprising:

at least two threaded apertures formed through said upper side of said wall structure in line with at least two of said enlarged openings and at least two threaded members adapted to be screwed into said threaded apertures and into said cavity for limiting movement of said first portion of said plunger in said cavity to that section of said cavity between said two threaded members.

4. The apparatus of claim 1, wherein said biasing means comprises a spring.

5. The apparatus of claim 1, wherein:

said slot comprises a plurality of narrow openings with each narrow opening leading to one of said enlarged openings, said end portion of said plunger having a cross-sectional size greater than that of said intermediate portion and said intermediate portion having a cross-sectional size greater than that of said second portion, said cross-sectional size of said intermediate portion being greater than said narrow portions of said slot for preventing said intermediate portions from passing through said narrow portions of said slot.

6. The apparatus of claim 5, comprising:

a threaded aperture formed through said upper side of said wall structure in line with at least one of said enlarged openings for receiving a threaded member adapted to be screwed into said threaded aperture and into said cavity for engaging said end portion of said plunger for holding said intermediate portion of said plunger in said one enlarged opening to prevent movement of said first portion of said plunger along said cavity.

7. The apparatus of claim 2, comprising:

a threaded member adapted to be screwed into said threaded aperture and into said cavity for engaging said end portion of said plunger for holding said intermediate portion of said plunger in said one enlarged opening to prevent movement of said first portion of said plunger along said cavity.

8. The apparatus of claim 6, comprising:

a threaded member adapted to be screwed into said threaded aperture and into said cavity for engaging said end portion of said plunger for holding said intermediate portion of said plunger in said one enlarged opening to prevent movement of said first portion of said plunger along said cavity.

9. The apparatus of claim 3, comprising:

two threaded members adapted to be screwed into said two threaded apertures with shafts extending and into said cavity for limiting movement of said first portion of said plunger in said cavity to that section of said cavity between said two threaded members.

10. A load supporting apparatus, comprising:

an elongated guide member having an upper side, a lower side, and two opposite end portions and adapted to be supported with said lower side facing downward, said member having wall structure forming an elongated cavity between said two opposite ends with an elongated slot, having a given length, formed through said wall structure located on said lower side leading to said cavity, said slot having a plurality of spaced apart enlarged openings, located along its length, a plunger having a first portion located in said cavity and a second portion extending through said slot, said plunger having a size and a shape sufficient for allowing said first portion and said second portion to move along the length of said cavity and slot respectively, biasing means normally urging said first portion of said plunger toward said upper side to normally maintain said first portion in said cavity, said first portion of said plunger comprising an end portion and an intermediate portion coupled between said end portion and said second portion, said end portion having a size greater than that of said end portion which prevents said end portion from passing through said enlarged openings, gripping means coupled to said second portion of said plunger for allowing a person below said guide member to move said plunger along said cavity and slot, said enlarged openings of said slot having sizes sufficient to allow said intermediate portion of said plunger to partially enter said enlarged openings when aligned therewith when a downward force is applied to said plunger by way of said gripping means to prevent movement of said plunger along said cavity with said end portion preventing said plunger from being removed from said slot by way of said enlarged openings, when said downward force is released, said biasing means moves said intermediate portion of said plunger out of any of said enlarged openings in which said intermediate portion of said plunger is located, support means coupled to said guide member which supports said guide member at an elevated position with said lower side and said slot facing downward, at least two threaded apertures formed through said upper side of said wall structure in line with at least two of said enlarged openings and at least two threaded members adapted to be screwed into said threaded apertures and into said cavity for limiting movement of said plunger in said cavity to that section of said cavity between said two threaded members, and two threaded members adapted to be screwed into said two threaded apertures with shafts extending and into said cavity for limiting movement of said first portion of said plunger in said cavity to that section of said cavity between said two threaded members.

* * * * *